US006105594A

United States Patent [19]

Diaz

[11] Patent Number: 6,105,594

[45] Date of Patent: Aug. 22, 2000

[54] ADJUSTABLE UMBRELLA SUPPORT APPARATUS FOR USE WITH WHEEL CHAIRS, GOLF CARTS, AND THE LIKE

[76] Inventor: Miguel Diaz, 305 Lowerline, New Orleans, La. 70118

[21] Appl. No.: 09/168,392

[22] Filed: Oct. 6, 1998

Related U.S. Application Data

[60] Provisional application No. 60/061,147, Oct. 6, 1997.

[51] Int. Cl.[7] ..... A45B 3/00

[52] U.S. Cl. ..... 135/16; 135/88.03

[58] Field of Search ..... 135/15.1, 16, 19, 135/21, 88.05, 88.01, 88.02, 88.03; 248/288.51

[56] References Cited

U.S. PATENT DOCUMENTS

| | | | |
|---|---|---|---|
| 3,304,035 | 2/1967 | Davis | 135/20.1 |
| 4,836,231 | 6/1989 | Peterson | 135/98 |
| 5,033,528 | 7/1991 | Volcani | 403/56 |
| 5,611,364 | 3/1997 | Woods | 135/23 |
| 5,641,191 | 6/1997 | Jia | 248/288.51 |
| 5,645,253 | 7/1997 | Hoshino | 248/288.31 |
| 5,937,881 | 8/1999 | Villa | 135/20.1 |

*Primary Examiner*—Beth A. Stephan
*Attorney, Agent, or Firm*—Garvey, Smith, Nehrbass & Doody, LLC

[57] ABSTRACT

An umbrella support device can be used with motorized wheel chairs, golf carts, and lawn mowers, or other such small wheeled vehicles. The apparatus includes a frame that fits the chassis or seat or receiver hitch of the vehicle, the frame preferably having a telescoping vertical portion. An umbrella handle socket is fitted to the upper end of the vertical member and receives the handle of an umbrella. The umbrella has two shaft portions that pivot one with respect to the other. The shaft sections of the umbrella can be mounted in an aligned position or in an angulated position wherein an angle of about ninety degrees is formed between the sections. The umbrella handle socket can be positioned horizontally to hold the handle and the lower of the umbrella shafts in a horizontal position so that the angulated upper shaft of the umbrella is in a vertical position directly above the head of a user that occupies the seat of the wheeled vehicle.

17 Claims, 4 Drawing Sheets

ADJUSTABLE UMBRELLA SUPPORT APPARATUS FOR USE WITH WHEEL CHAIRS, GOLF CARTS, AND THE LIKE

CROSS-REFERENCE TO RELATED APPLICATIONS

Provisional U.S. Patent Application Ser. No. 60/061,147, filed Oct. 6, 1997, is incorporated herein by reference.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to umbrella devices and more particularly to an umbrella device with a removable, adjustable support for attaching that umbrella device to wheeled vehicles, such as lawn mowers, motorized wheel chairs, golf carts and the like.

2. General Background of the Invention

Accessories for motorized wheel devices are sold by Electric Mobility of Sewell, N.J. Many of these products are sold under the trademark "Rascal". The Rascal accessories include a "weather breaker" top that attaches to the back of a seat of an electric cart. Shoprider, U.S.A., Inc. sells a number of electrical scooters, some of which are equipped with accessories for carrying objects.

One of the problems with umbrella devices that are attached to wheeled vehicles such as golf carts, motorized wheel chairs, lawn mowers and the like is that they extend from a position that is either too close to the user so that it encumbers the user's free upper body movement or the umbrella is so far away from the user that it does not adequately shade the user.

BRIEF SUMMARY OF THE INVENTION

It is an object of the present invention to provide an improved adjustable umbrella apparatus that can be attached to any of a variety of small motorized vehicles such as lawn mowers, golf carts, wheel chairs, motorized wheel chairs scooters, and the like, and wherein a unique mounting arrangement positions the center of the umbrella directly over the head of the user.

The present invention provides an umbrella support apparatus for use with motorized vehicles such as electric golf cart, electric motorized wheel chairs, and lawn mowers, said vehicles each having a chassis and a seat.

An adjustable frame is provided that includes a vertically extending telescoping portion that can be elevated or lowered.

An attachment forms an interface between the frame and the motorized vehicle.

A handle receptacle is mounted at the upper end of the telescoping member, the handle receptacle being sized and shaped to receive and hold an umbrella handle.

An umbrella is provided that includes and elongated shaft that is comprised of two shaft sections that pivot one upon the other. The umbrella section can be affixed in an aligned position or in an angled position that orients the upper section at a substantial angle with respect to the lower section. A locking mechanism can be used to hold the umbrella in either the angulated or the aligned position.

The frame and umbrella section support the umbrella above the head of a user that is seated on the seat of the vehicle.

The handle receptacle can be configured to enable the umbrella to rotate into multiple positions relative to the frame.

The locking mechanism can includes openings in upper and lower shaft sections and a locking pin that can be inserted through the openings. A plurality of the openings are provided so that the umbrella can preferably be locked in an aligned position or in an angled position. In another embodiment, a strap or tie at the periphery of the umbrella connects to the frame to hold the umbrella in the angled position.

An attachment that forms an interface with the chassis of the vehicle can for example be in the form of an attachment to the vehicle seat, to a receiver hitch, or to body parts of the vehicle.

In one embodiment, the receptacle is comprised of a plurality of flat sides and the umbrella handle includes a corresponding plurality of flat sides. For example, the umbrella handle can have a hexagonal or octagonal transverse cross section with a similar transverse cross section being provided to the receptacle.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein:

FIG. 14 is a fragmentary view illustrating a clamp arrangement for mounting the apparatus of FIGS. 7–12 to a flat surface such as a table or the like.

DETAILED DESCRIPTION OF THE INVENTION

Figure 1:
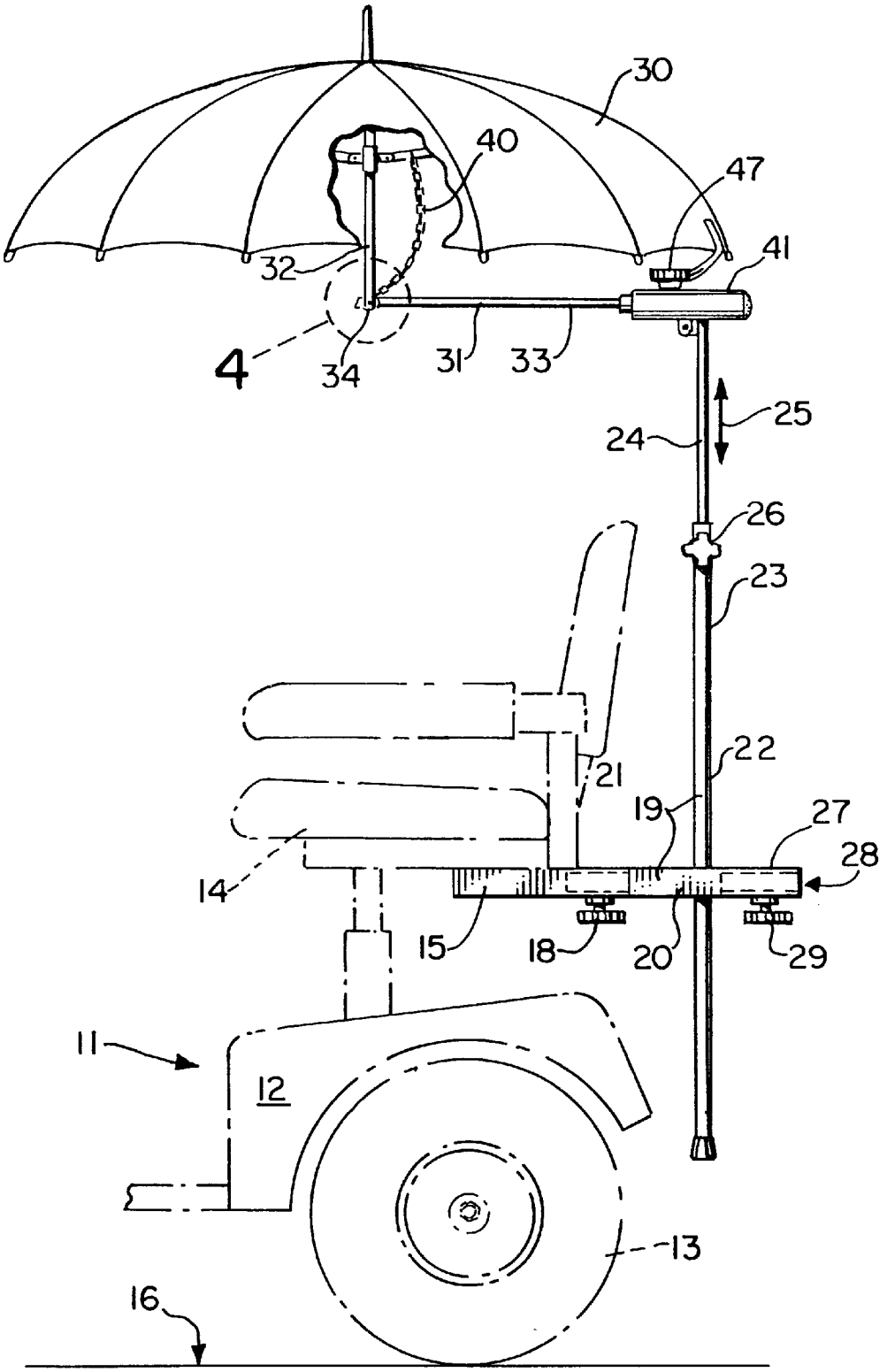
FIG. 1 is a side elevational view of the preferred embodiment of the apparatus of the present invention.

Umbrella support apparatus 10 can be used in combination with any of a number of small vehicles such as the vehicle 11 which is shown in partial, elevational view in FIG. 1. Such a vehicle 11 can be for example, a golf cart, motorized electric wheel chair, lawn mower, or the like. Vehicle 11 typically has a metallic frame 12 with wheels 13 and a seat in addition to an engine or motor (not shown). Frame 12 can support a receiver hitch 15 having a socket 17. In FIG. 1, the underlying ground support 16 is shown for purposes of illustration.

Figure 3:
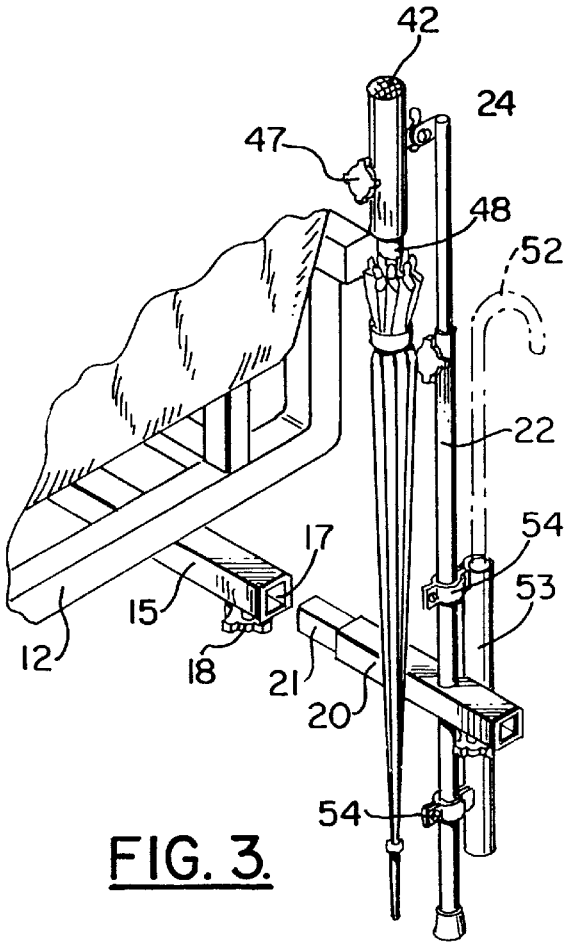
FIG. 3 is another fragmentary perspective view of the preferred embodiment of the apparatus of the present invention illustrating the attachment of the support frame to the hitch of a wheeled vehicle.

Receiver hitch 15 has socket 17 that receives a correspondingly shaped projecting connector portion 21 of adjustable umbrella support frame 19. Adjustable frame 19 includes horizontal member 20 having connector 21 thereon that fits socket 17 as shown in FIGS. 1 and 3. Set screw 18 can be used to tighten the connection between receiver hitch 15 and horizontal member 20 at connector 21 when the two parts are assembled one into the other as shown in FIG. 1. Adjustable frame 19 includes vertical member 22 that is comprised of a lower section 23 that can be affixed by welding for example to horizontal member 20, and upper section 24 that slides up and down as shown by the arrow 25 in FIG. 1. Thus, the sections 23 and 24 are telescoping sections so that the section 24 can be elevated to adjust the position of umbrella 30 relative to seat 14 and the user seated thereon.

Set screw 26 can be used to affix the upper section 24 in a desired elevational position relative to the lower section 23. Horizontal member 20 can provide its own receiver 27 having socket 28 with a set screw 29 so that other additional accessories such as a rack or basket or the like can be attached to the frame 19.

Figure 5:
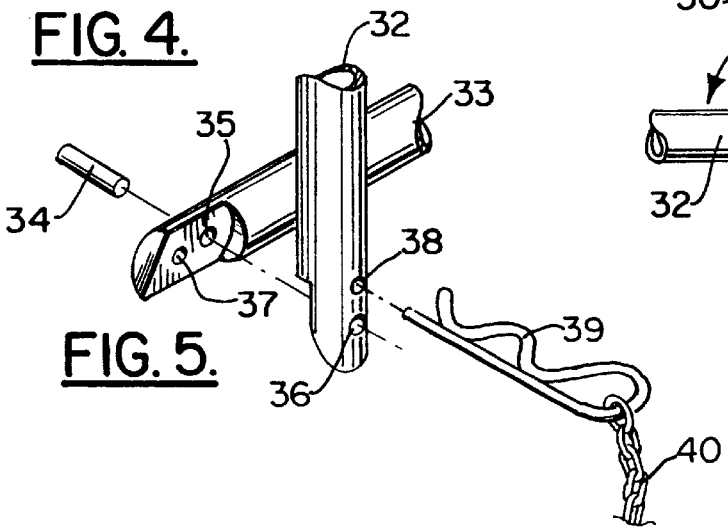
FIG. 5 is a fragmentary, perspective view of the preferred embodiment of the apparatus of the present invention illustrating the connection between sections of the umbrella shaft.
Figure 6:
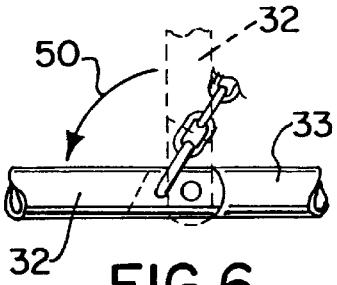
FIG. 6 is a side fragmentary, elevational view of the preferred embodiment of the apparatus of the present invention illustrating connection between the umbrella shaft sections.

Umbrella 30 is supported by shaft 31 that is comprised of upper section 32, and lower section 33. The upper and lower sections 32, 33 pivot at pivot pin 34. Pivot pin 34 can be a rivet for example, or like pinned connection that extends through opening 35 of shaft section 33 and opening 36 of shaft section 32. A locking pin 39 is used to affix the umbrella shaft sections 32, 33 in an aligned vertical position as shown in FIG. 6 using pin 39 through openings 37, 38, or in an offset position as shown in FIGS. 1 and 4–5.

Figure 4:
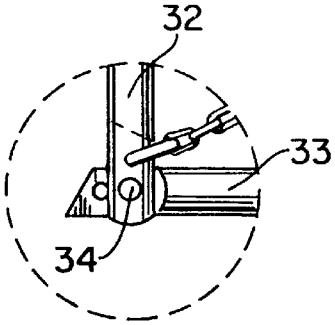
FIG. 4 is a fragmentary elevational view of the preferred embodiment of the apparatus of the present invention.

The offset position is achieved by putting the pin 39 through the opening 38 only so that it engages the opening 38 and the side of section 33 as shown in FIG. 4. This functions to hold the sections 32, 33 in an orientation of about ninety degrees with respect to each other, as shown in FIGS. 1, 4 and 5. The pin 39 can be supported upon a selected portion of the umbrella structure as shown in FIG. 1 with retainer chain 40.

Figure 2:
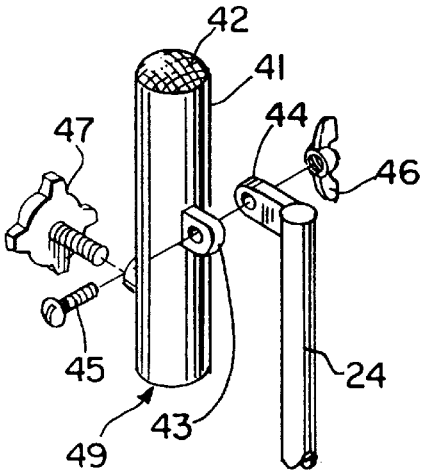
FIG. 2 is a perspective, fragmentary view of the preferred embodiment of the apparatus of the present invention.

Umbrella 30 has handle 48 that fits socket 49 of handle receptacle 41. Receptacle 41 is mounted upon the upper end of upper section 24 of vertical member 22 at pad eyes 43, 44 using a bolted connection such as the bolt 45 and wing nut 46 shown in FIG. 2. Set screw 47 extends through the wall of receptacle 41 as shown in FIGS. 1, 2 and 3. The set screw 47 extends into socket 49 for gripping handle 48 of umbrella 30 to hold the umbrella securely during use or when collapsed as shown in FIG. 3.

By loosening the bolted connection of bolt 45 and wing nut 46, handle receptacle 41 can be generally aligned with vertical member as shown in FIGS. 2 and 3. This alignment enables the umbrella 30, when collapsed, to be aligned generally with vertical member 22 for storage when not in use (see FIG. 3).

In FIG. 3, vertical member 22 can provide a support for other accessories such as the cane holder 53 that includes tube 51 and its attachments 54 to vertical member 22. In FIG. 3, tube 51 holds a cane 52, for example. In FIG. 1, the umbrella 30 is shown in operating position wherein the sections 32, 33 are oriented ninety degrees with respect to each other. This is the position shown in FIGS. 5 and 6 of the sections 32, 33 and places the umbrella 30 directly above the seat 14 and the head of the user that would be positioned thereon.

When the umbrella sections 32, 33 are aligned as shown in FIG. 6, by rotating the section 32 relative to the section 33 so that they are generally aligned and as shown by arrow 50 in FIG. 6, this enables the umbrella 3 to assume the configuration of FIG. 3 and be used as a conventional umbrella if so desired.

Figure 10:
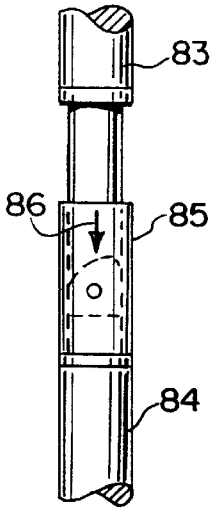
FIG. 10 is a partial elevational view of the alternate embodiment of the apparatus of the present invention illustrating the connection between upper and lower sections of the umbrella shaft.
Figure 11:
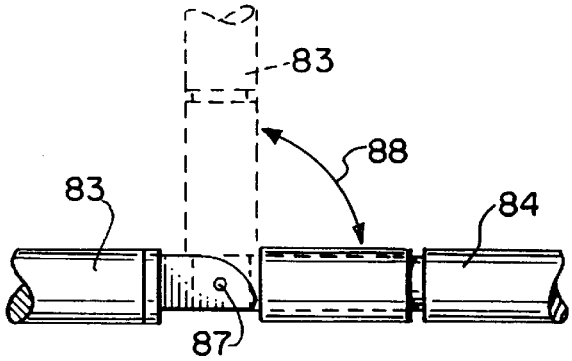
FIG. 11 is a partial elevational view of the alternative embodiment of the apparatus of the present invention showing movement of the upper and lower umbrella shaft portions between aligned and folded positions.
Figure 12:
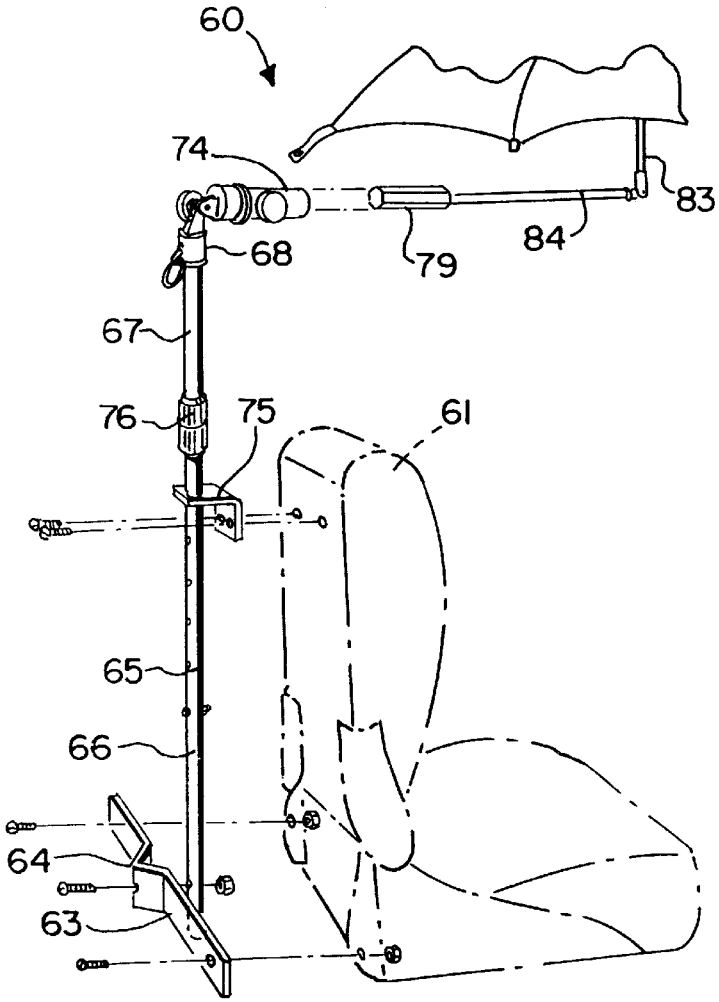
FIG. 12 is a perspective view of the alternate embodiment of the apparatus of the present invention.

FIGS. 7–14 show a second, alternate embodiment of the apparatus of the present invention designated generally by the numeral 60 in FIG. 12.

In FIG. 12, umbrella support apparatus 60 is shown attached to a vehicle seat 61 at upper and lower spaced apart positions.

Figure 13:
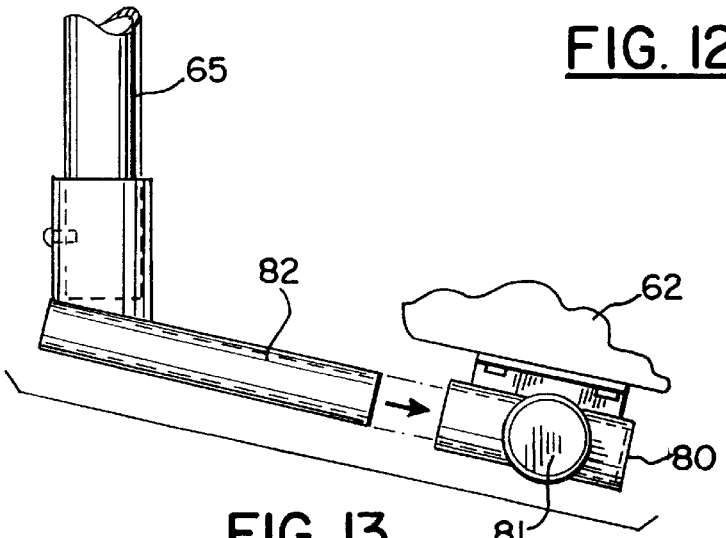
FIG. 13 is a fragmentary view of the alternate embodiment of the apparatus of the present invention showing an additional connection for attaching the apparatus to a vehicle.

In FIG. 13, a vehicle chassis 62 provides an inclined socket 80 and set screw 81 for clamping a hitch 82 to the socket 80 of the chassis 62. In FIG. 12, the upper and lower supports include and upper bracket 75 and a lower transverse support 63 having a notched section 64. The notched section 64 cradles lower tube section 66 of telescoping tube 65. The bracket 65 provides an opening through which the telescoping tube 65 extends as shown in FIG. 12. The bracket 75 attaches to the top of the seat back of seat 61. The transverse support 63 attaches to the bottom rear portion of the seat 61 as shown in FIG. 12.

Upper tube section 67 telescopes up and down with respect to lower tube section 66. A fitting 76 that is commercially available in the form of a pair of annular members are threadably attached together to enable a tightened connection to be made between lower tube section 66 and upper tube section 67. Two annular members are tightened one upon the other to form a wedge lock to taper lock connection with upper tube section 67.

Figure 7:
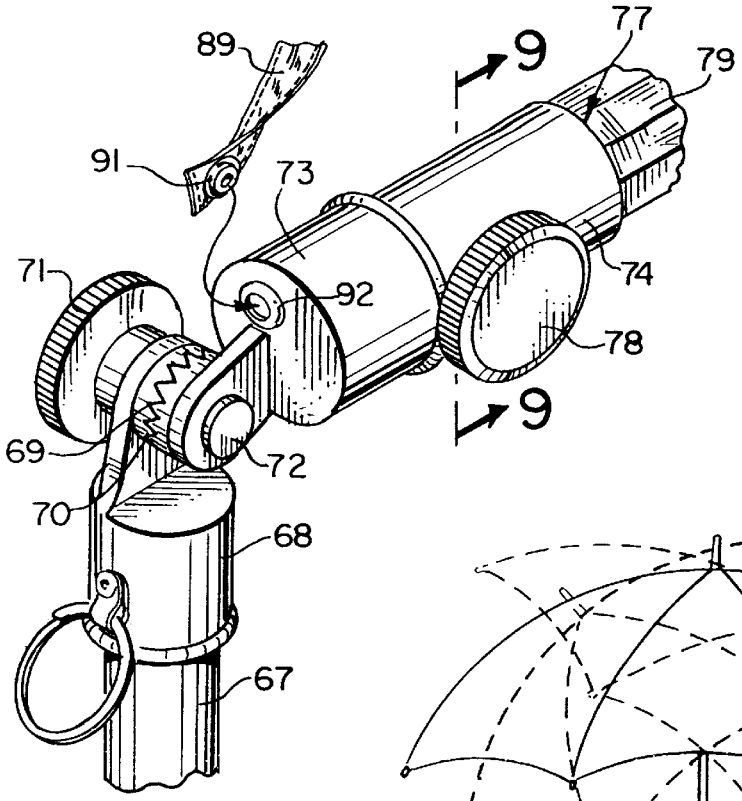
FIG. 7 is perspective fragmentary view of a second, alternate embodiment of the apparatus of the present invention.
Figure 9:
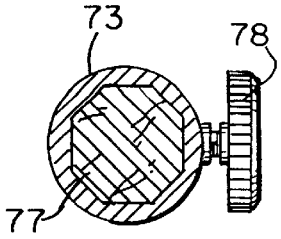
FIG. 9 is a sectional view taken along lines 9—9 of FIG. 7.
Figure 8:
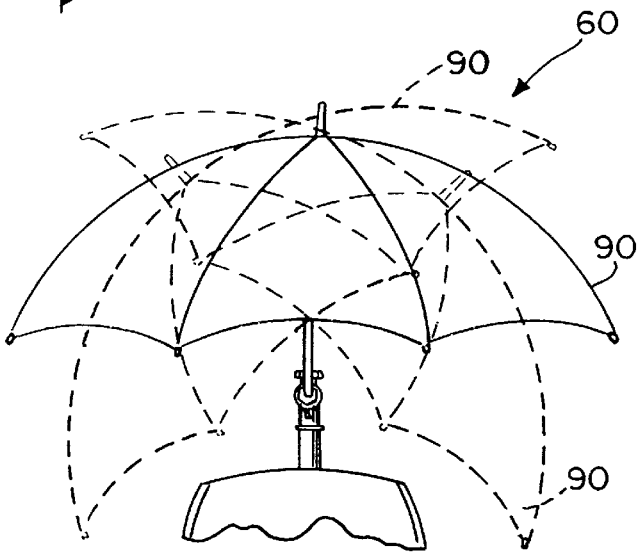
FIG. 8 is a fragmentary perspective view of the alternate embodiment of the apparatus of the present invention.

In FIGS. 7 and 12, the upper tube section 67 is shown attached to sleeve 68. In FIG. 7, knob 71 can be loosened to allow the toothed portions 69, 70 to rotate one with respect to the other until the desired angular orientation is achieved as shown in FIGS. 7 and 12. Receptacle 73 provides a bore 77 that is preferably hexagonal or octagonal in internal cross sectional configuration as shown in FIG. 9 for receiving a similarly configured hexagonal or octagonal handle 79 portion of umbrella 90. Set screw 78 affixes handle 79 in bore 77 as shown in FIGS. 7 and 9. The umbrella 90 can be moved into different positions by pivoting the handle 76 relative to receptacle 73 and then placing the handle 76 into the bore 77 at the desired rotational position as shown in phantom lines in FIG. 8.

The umbrella 90 has an upper shaft 83 and a lower shaft 84. These shaft sections 83, 84 can be angled with respect to each other as shown in FIGS. 12 and 11 are aligned with one another as shown in FIG. 10. Sleeve 85 moves up and down as shown by arrow 86 in FIG. 10 to enable movement of the shaft sections 83, 84 between the aligned position of FIG. 10 and the angled position shown in phantom lines in FIG. 11. The user simply raises the sleeve 85 toward upper shaft section 83 to expose the pivoting joint 87 so that the upper shaft 83 can pivot with respect to the lower shaft 84 as shown by arrow 88 in FIG. 11.

Umbrella 90 at its periphery provides strap 89 with snap member 91 that fits a corresponding snap member 92 for affixing the periphery of the umbrella to receptacle 73 when the upper section 83 is angled with respect to the shaft section 84 as shown in FIGS. 7 and 12.

Figure 14:
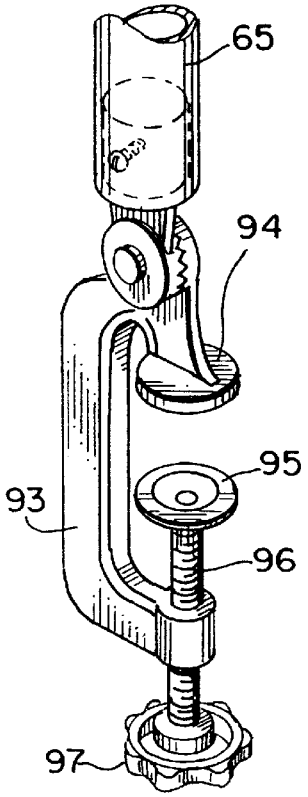

In FIG. 14, a bracket 93 is shown that enables the telescoping tube 65 to be attached to any surface that can be clamped between clamp members 94, 95 such as a chair, bench, table, wall or the like. The entire bracket 93 could also be buried in sand for beach use. The clamp member 95 is mounted upon threaded shaft 96 that can be rotated with know 97. Otherwise, the connection between bracket 93 and telescoping shaft 65 can be in the form of a pair of annular toothed portions 69, 70 that engage one another as is the case with the embodiment of FIG. 7. FIG. 14 could similarly enable to rotate the telescoping shaft 65 relative to bracket 93 and an object to which it is attached.

The following table lists the parts numbers and parts descriptions as used herein and in the drawings attached hereto.

PARTS LIST

| Part Number | Description |
|---|---|
| 10 | umbrella support apparatus |
| 11 | vehicle |
| 12 | frame |
| 13 | wheel |
| 14 | seat |
| 15 | receiver hitch |
| 16 | ground |
| 17 | socket |
| 18 | set screw |
| 19 | adjustable umbrella support frame |
| 20 | horizontal member |
| 21 | connector |
| 22 | vertical member |
| 23 | lower section |
| 24 | upper section |
| 25 | arrow |
| 26 | set screw |
| 27 | receiver |
| 28 | socket |
| 29 | set screw |
| 30 | umbrella |
| 31 | shaft |
| 32 | upper section |
| 33 | lower section |
| 34 | pivot pin |
| 35 | opening |
| 36 | opening |
| 37 | opening |
| 38 | opening |
| 39 | locking pin |
| 40 | retainer chain |
| 41 | handle receptacle |

-continued

PARTS LIST

| Part Number | Description |
|---|---|
| 42 | reflector |
| 43 | pad eye |
| 44 | pad eye |
| 45 | bolt |
| 46 | wing nut |
| 47 | set screw |
| 48 | umbrella handle |
| 49 | socket |
| 50 | arrow |
| 51 | tube |
| 52 | cane |
| 53 | cane holder |
| 54 | attachment |
| 60 | umbrella support |
| 61 | vehicle seat |
| 62 | vehicle chassis |
| 63 | transverse support |
| 64 | notched section |
| 65 | telescoping tube |
| 66 | lower tube section |
| 67 | upper tube section |
| 68 | sleeve |
| 69 | annular toothed portion |
| 70 | annular toothed portion |
| 71 | knob |
| 72 | shaft |
| 73 | receptacle |
| 74 | receptacle wall |
| 75 | intermediate support bracket |
| 76 | fitting |
| 77 | bore |
| 78 | set screw |
| 79 | handle |
| 80 | receiver |
| 81 | set screw |
| 82 | hitch |
| 83 | upper shaft |
| 84 | lower shaft |
| 85 | sleeve |
| 86 | arrow |
| 87 | pivoting joint |
| 88 | arrow |
| 89 | strap |
| 90 | umbrella |
| 91 | snap member |
| 92 | snap member |
| 93 | bracket |
| 94 | clamp member |
| 95 | clamp member |
| 96 | threaded shaft |
| 97 | knob |

The foregoing embodiments are presented by way of example only; the scope of the present invention is to be limited only by the following claims.

What is claimed is:

1. An umbrella support apparatus for use with motorized vehicles such as golf carts, motorized wheel chairs, lawn mowers, said vehicles each having a chassis and a seat, comprising:

a) an adjustable frame that includes a vertically extending portion;

b) an attachment forming an interface between the frame and the motorized vehicle;

c) a handle receptacle mounted at the upper end of the handle receptacle being sized and shaped to receive and hold an umbrella handle;

d) an umbrella that includes an elongated shaft comprised of upper and lower shaft sections that pivot, one with respect to the other;

e) wherein the umbrella sections can be affixed in an aligned position, or in an angled position that orients the upper shaft section at a substantial angle with respect to the lower shaft section;

f) a locking mechanism for holding the umbrella in the angled position; and g) wherein the frame and umbrella sections support the umbrella above a user seated on the seat of a vehicle.

2. The umbrella support apparatus of claim 1 wherein the frame includes telescoping portions that enable the height of the frame to be varied.

3. The umbrella support apparatus of claim 1 wherein the handle receptacle is configured to enable the umbrella to rotate into multiple positions relative to the frame.

4. The umbrella support apparatus of claim 1 wherein the locking mechanism includes openings in the upper and lower shaft sections and a locking pin that can be inserted through said openings.

5. The umbrella support apparatus of claim 1 wherein the attachment forms an interface with the seat of the vehicle.

6. The umbrella support apparatus of claim 1 wherein the attachment forms an interface with the chassis of the vehicle.

7. The umbrella support apparatus of claim 1 wherein said handle receptacle has a generally cylindrical socket.

8. The umbrella support apparatus of claim 1 wherein said handle receptacle has a generally hexagonal socket.

9. The umbrella support apparatus of claim 1 wherein the receptacle is comprised of a plurality of flat sides and the umbrella handle includes a corresponding plurality of flat sides.

10. An umbrella support apparatus for use with motorized vehicles such as golf carts, motorized wheel chairs, and lawn mowers having a seat for holding a user, comprising:

a) a support carried by the vehicle;

b) an adjustable frame that mounts to the support, the frame including a an upper end, a lower end, and telescoping member that includes a movable portion that can be elevated or lowered;

c) a receptacle mounted at the upper end of the frame, the receptacle being sized and shaped to receive an umbrella handle;

d) an umbrella having a handle, frame and canopy and that includes as part of the frame an elongated shaft comprised of two shaft sections that pivot one with respect to the other;

e) a locking mechanism for holding the umbrella in selected, angled or aligned positions, wherein in said angled position, one shaft section forms an angle with the other; and f) wherein the frame and umbrella sections support the umbrella substantially above a user seated on the seat of the vehicle.

11. The umbrella support apparatus of claim 10 wherein the handle receptacle is configured to enable the umbrella to rotate into multiple positions relative to the frame.

12. The umbrella support apparatus of claim 10 wherein the locking mechanism includes openings in the upper and lower shaft sections and a locking pin that can be inserted through said openings.

13. The umbrella support apparatus of claim 10 wherein the receptacle is comprised of a plurality of flat sides and the umbrella handle includes a corresponding plurality of flat sides.

14. The umbrella support apparatus of claim 10 wherein the locking mechanism includes openings in the upper and lower shaft sections and a locking pin that can be inserted through said openings.

15. An umbrella support apparatus for use with motorized vehicles such as golf carts, motorized wheel chairs, and lawn mowers comprising:

a) a receiver hitch carried by the vehicle;

b) a n adjustable frame that mounts to the receiver, the frame including upper and lower end portions, and a vertically extending telescoping portion that can be elevated or lowered;

c) a handle receptacle mounted at the upper end of the frame, the handle receptacle being sized and shaped to receive and hold an umbrella handle;

d) an umbrella that includes an elongated shaft comprised of two shaft sections that pivot one with respect to the other between an aligned position and an angled position that enables orientation of the sections at an angle of about ninety degrees with respect to each other;

e) a locking mechanism for holding the umbrella in either the aligned position or the angled position; and f) wherein the frame and umbrella sections support the umbrella directly above a user seated on the seat of a vehicle.

16. An umbrella support apparatus for use with motorized vehicles such as golf carts, motorized wheel chairs, and lawn mowers comprising:

a) a receiver hitch carried by the vehicle;

b) an adjustable frame that mounts to the receiver, the frame including upper and lower end portions, and a vertically extending telescoping portion that can be elevated or lowered;

c) a handle receptacle mounted at the upper end of the frame, the handle receptacle being sized and shaped to receive and hold an umbrella handle;

d) an umbrella that includes an elongated shaft comprised of two shaft sections that pivot one with respect to the other between an aligned position and angled position.

17. An umbrella support apparatus for use with motorized vehicles such as golf carts, motorized wheel chairs, lawn mowers, said vehicles each having a chassis and a seat, comprising:

a) a vehicle;

b) an adjustable frame that includes a vertically extending portion;

c) an attachment forming an interface between the frame and the motorized vehicle;

d) a handle receptacle mounted at the upper end of the, the, handle receptacle being sized and shaped to receive and hold an umbrella handle;

e) an umbrella that includes an elongated shaft comprised of upper and lower shaft sections that pivot, one with respect to the other;

f) wherein the umbrella sections can be affixed in an aligned position, or in an angled position that orients the upper shaft section at a substantial angle with respect to the lower shaft section;

g) a locking mechanism for holding the umbrella in the angled position; and h) wherein the frame and umbrella sections support the umbrella above a user seated on the seat of a vehicle.

* * * * *